US005622273A

United States Patent [19]

Kelly

[11] Patent Number: 5,622,273

[45] Date of Patent: Apr. 22, 1997

[54] RESEALABLE SNAP-FIT PLASTIC CLOSURE

[75] Inventor: Ronald L. Kelly, Chester, Va.

[73] Assignee: Crown Cork & Seal Company, Inc., Philadelphia, Pa.

[21] Appl. No.: 528,714

[22] Filed: Sep. 15, 1995

[51] Int. Cl.[6] ..... B65D 55/02

[52] U.S. Cl. ..... 215/237; 215/250; 220/319; 220/339

[58] Field of Search ..... 215/235, 237, 215/238, 250, 253, 256, 274, 310, 320; 220/334, 339, 319; 222/153, 541; 116/70, 85, 99, 67 R

[56] References Cited

U.S. PATENT DOCUMENTS

| | | | |
|---|---|---|---|
| 3,703,975 | 11/1972 | Wittemer | 215/213 |
| 4,327,842 | 5/1982 | Walter | 215/237 X |
| 4,356,924 | 11/1982 | Walter | 215/237 |
| 4,361,244 | 11/1982 | Walter | 215/237 X |
| 4,369,888 | 1/1983 | Walter | 215/237 |
| 4,462,504 | 7/1984 | Roth et al. | 215/237 X |
| 4,519,517 | 5/1985 | Walter | 215/253 |
| 4,645,086 | 2/1987 | Rosenthal | 215/235 |
| 4,778,072 | 10/1988 | Newman | 215/253 |
| 4,852,764 | 8/1989 | Stone | 220/339 X |
| 4,969,574 | 11/1990 | Shastal | 215/253 X |
| 4,974,735 | 12/1990 | Newell et al. | 215/235 X |

*Primary Examiner*—Allan N. Shoap
*Assistant Examiner*—Nathan Newhouse
*Attorney, Agent, or Firm*—Woodcock Washburn Kurtz Mackiewicz & Norris

[57] ABSTRACT

A plastic closure includes an annular ring durably attached to the container, and a sealing assembly installed in the ring to seal the mouth. The sealing assembly includes a plug having a sealing lip on its lower face and a release lever connected to the plug by a flexible hinge. A tab on the release lever can be lifted to pry the sealing assembly out of the opening. The ring has a free edge directed downwardly and inwardly so as to permit the plug to pass easily through the opening during assembly, or resealing, but to resist removal of the plug sufficiently to prevent it from being forced off the container by pressure within the container.

15 Claims, 3 Drawing Sheets

FIG.1
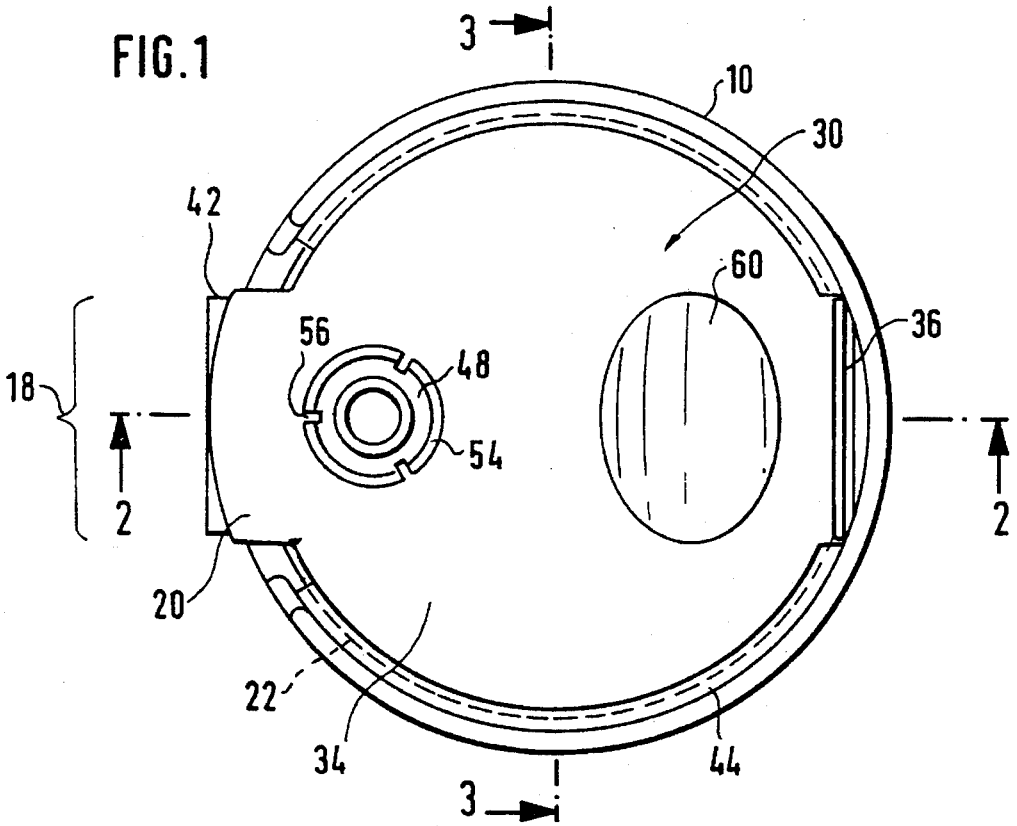
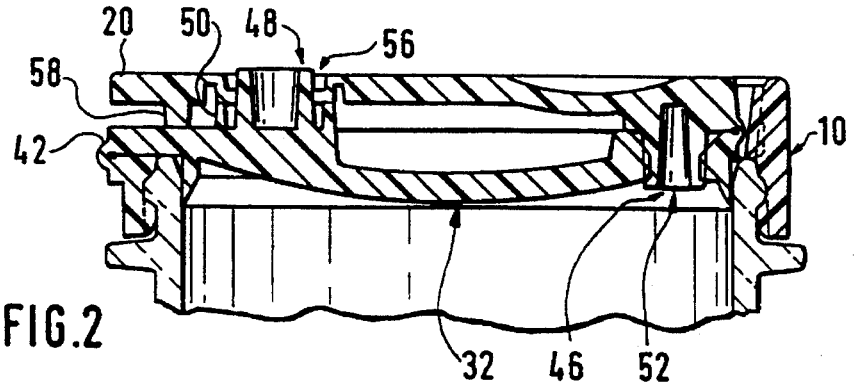
FIG.2
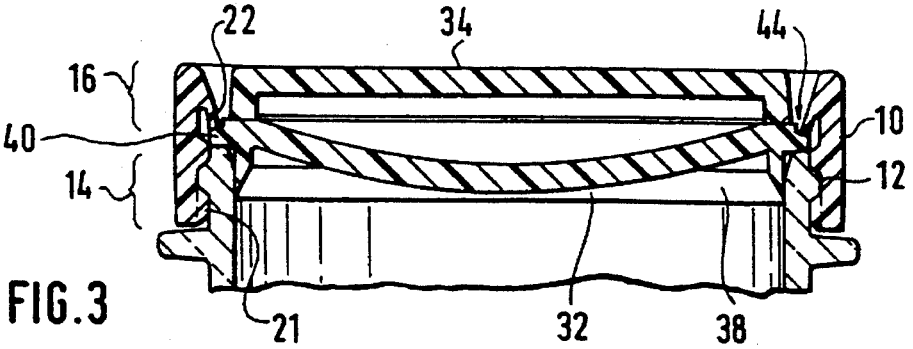
FIG.3

FIG. 5
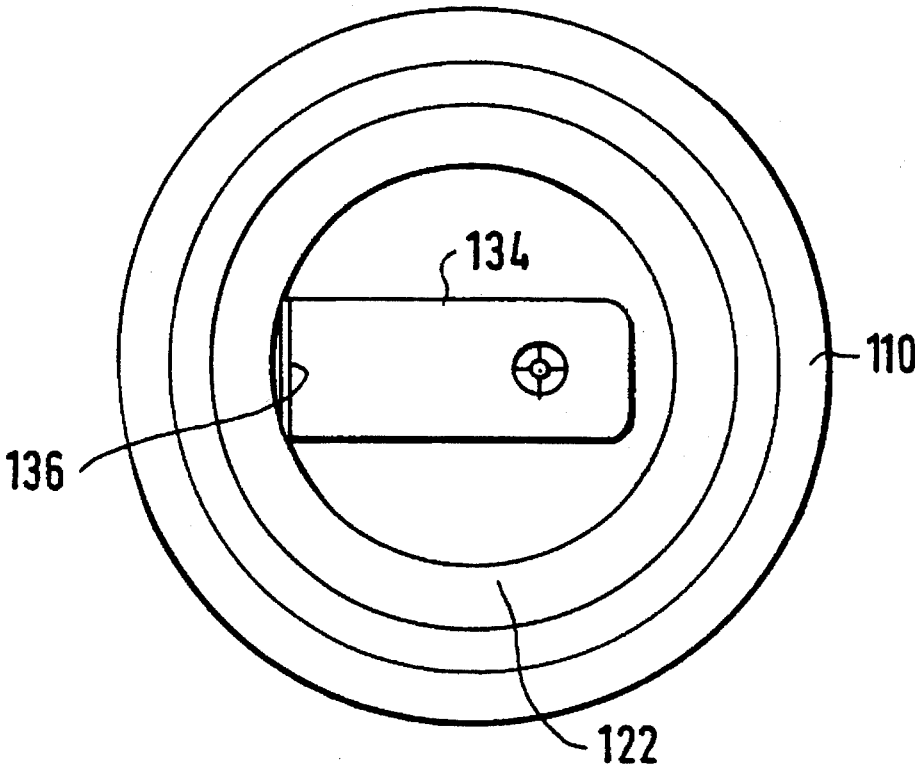
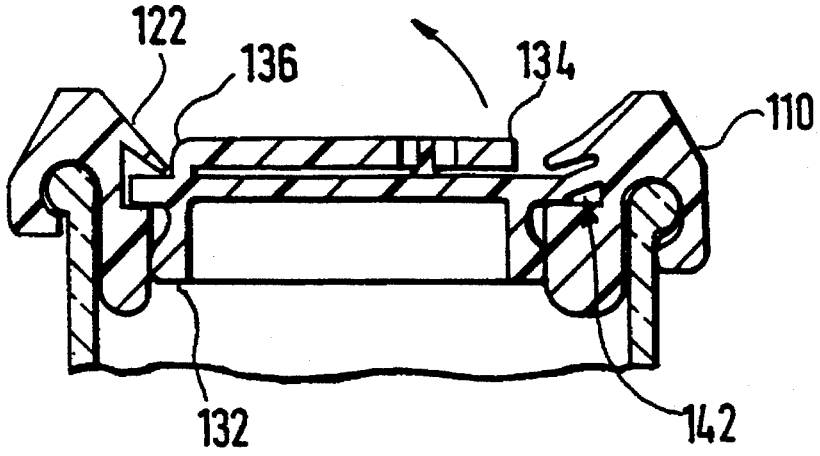
FIG. 6

RESEALABLE SNAP-FIT PLASTIC CLOSURE

BACKGROUND OF THE INVENTION

This invention relates to the art of closures for liquid containers, and more particularly to a snap-in closure for a beverage container or the like.

There are a number of closures which are pushed into the mouth of a container, or a fitting at the mouth, seating with a "snap". Typically, there is an interference fit between the parts, at least one of which elastically deforms during installation sufficiently to allow cooperating detent structure or the like to engage. Known snap-fit plastic closures have certain disadvantages. For one, in order to safely hold high pressure in a container, the required interference fit between the seal plug and the locking ring of the closure may result in an unacceptably large resealing force when one attempts to press the closure back into place. This is particulary so for large-mouth closures. And some such closures are damaged in the opening process, so they cannot be resealed at all.

Also, as resealable closures are vulnerable to tampering, it is desirable to provide a tamper evidencing scheme which is difficult or impossible to defeat.

SUMMARY OF THE INVENTION

An object of the invention is to provide a snap-fit plastic closure which can be easily reinstalled in a container after having been removed.

Another object of the invention is to facilitate removal of a container closure having a locking feature to prevent container pressure from blowing the closure off the container.

A further object of the invention is to provide an indication that such a closure has been opened, as a deterrent and safeguard against tampering.

These and other objects are attained by a plastic closure which includes an annular ring durably attached to the container, and a sealing assembly installed in the ring to seal the mouth. The sealing assembly includes a plug having a sealing lip on its lower face and a release lever connected to the plug by a flexible hinge. A tab on the release lever can be lifted to break tamper-evident webs initially holding the lever folded against the plug. When the lever is opened fully, past vertical, it engages the outer ring and pries the sealing assembly out of the opening. The ring has a free edge directed downwardly and inwardly so as to permit the plug to pass easily through the opening during assembly, or resealing, but to resist removal of the plug sufficiently to prevent it from being forced off the container by carbonation pressure within the container. The durable attachment of the annular ring to the container keeps the ring in place against the carbonation pressure within the container or the opening and withdrawal forces of the lever and the plug. However, under increased pressure the ring my be pried or cut off when it must be separated from the container. This may be essential, for example, if a container is to be returned for re-use or when the ring and the container are of different materials which are to be separated for recycling purposes.

BRIEF DESCRIPTION OF THE DRAWINGS

In the accompanying drawings,

FIG. 1 is a top plan view of a resealable snap-fit plastic closure embodying the invention;

FIG. 2 is a sectional view thereof, taken on the plane 2—2 in FIG. 1;

FIG. 3 is a sectional view thereof, taken on the plane 3—3 in FIG. 1.

FIGS. 5 and 6 are views like FIGS. 1 and 4 respectively, showing a second embodiment of the invention.

DESCRIPTION OF THE PREFERRED EMBODIMENT

Figure 4:
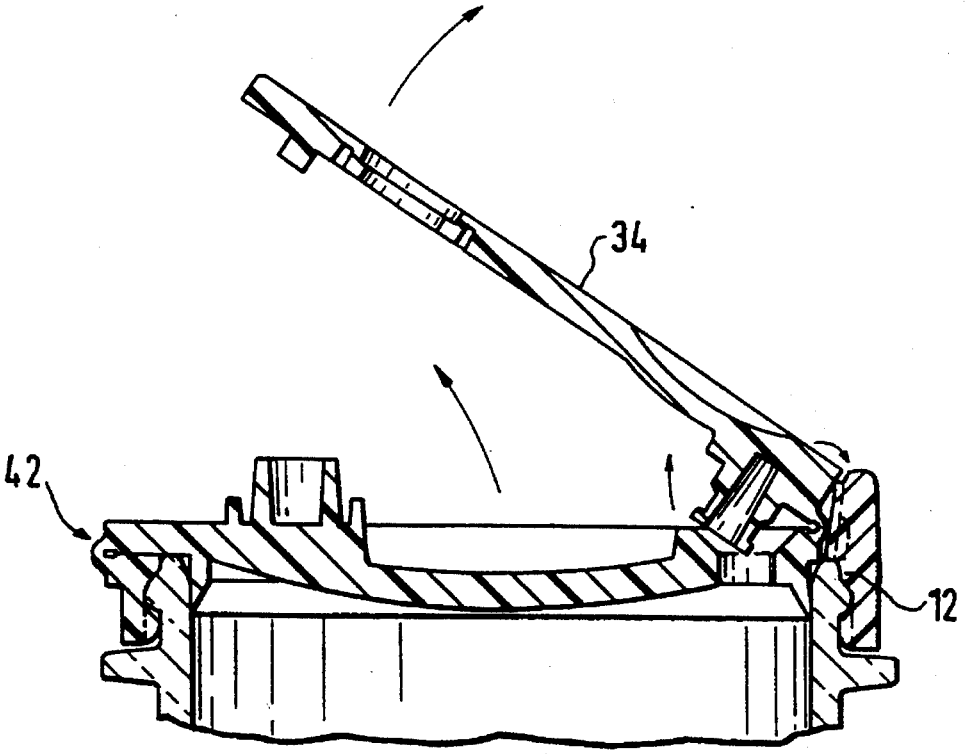
FIG. 4 is a view like FIG. 2, showing the closure being removed from its container.

A plastic closure embodying the invention is shown in FIGS. 1–4. It is shown installed at the upper end of a bottle, only the neck of which appears in the drawings. The neck illustrated has a lower peripheral flange, which is not important to this invention, and a smaller circumferential bead near the mouth of the bottle. The bead is important because it retains the outer ring 10 of the closure, which has an internal groove 12 that receives the bead as the ring is pressed onto the neck. It is possible, however, that the bead could be replaced by a functional equivalent, such as an adhesive connection between the bottle neck and the outer the ring. Regardless, the lower portion 14 of the outer ring, below the bottle mouth, has a 360° extent, while (see FIG. 1), the upper portion 16 has an interruption 18 of about 45°–60° extent to provide clearance for a pull tab 20 described below. The ring has an annular flap 21 which is folded upward during installation on the bottle, to lodge under the bead, and has circumferentially spaced scoring lines that break if an attempt is made to remove the ring from the bottle, to provide an indication of tampering.

A particularly important feature of this invention is the downwardly and inwardly directed free edge 23. Edge 23 is positioned on an annular locking lip or skirt 22 which extends around the inside surface of the outer ring 10, and is directed inwardly and downwardly at a small angle from the vertical. In its free, as-molded configuration, there is a space between the skirt and the inner surface of the outer ring, so that the skirt can be deflected outwardly to permit installation of the closure plug assembly 30. The closure assembly is separate from the outer ring, which acts as a retainer to hold the plug against or within the bottle mouth.

The closure assembly 30 includes a dished plug 32 and a release lever 34, interconnected by a flexible "living" hinge 36 at one edge. The plug has a circumferential sealing lip 38, which extends downward into the bottle mouth, and a peripheral overhang 40 which engages the top surface of the mouth and acts as a stop. At the side opposite the hinge, the overhang has a hinge 42 lying below, and about the same size as the tab 20. Hinge 42 connects the plug 32 to outer ring 10. The upper periphery of the plug, except in the areas of the hinge and the extension, is undercut at 44.

The plug's surface is interrupted by a vent hole 46, near the hinge 36, and a hollow boss 48 near the extension 40. The boss is surrounded by an annular standoff 50. The release lever, correspondingly, has a vent plug 52 which seals the vent hole normally, and a circular opening 54 which receives the boss. During manufacture, the closure assembly is injection molded flat open, then folded along the hinge to the closed configuration shown in FIGS. 2 and 3. It is held in the closed configuration by three radial webs 56 which connect the boss to the interior of the opening. A rib 58 on the bottom of the tab seats against the top of the extension.

With the outer ring pre-installed on the bottle neck, the sealing assembly is pressed into the ring until it seats against the top of the mouth, which is far enough for the overhang to clear the skirt 22, and hollow it to spring back into its normal unflexed position above the undercut. Withdrawal is now prevented; the vertical edges of the undercut keep the skirt from being folded backward by container pressure.

Alternatively, the plug 32 may be pre-installed in ring 10 and the completed closure assembly may be positioned on the bottle finish to close it.

To remove the closure assembly, one lifts the tab with enough force to break the tamper-evident webs, then folds the lever back until its upper surface engages the top of the outer ring, which acts as a fulcrum. By now, the vent is open, releasing container pressure so that the closure is not forced out of the mouth. further movement of the lever pries the closure plug out of the ring, overcoming the retention force of the skirt, without destroying it.

One can reinstall the closure by pressing it into the ring until it is once again locked in place. A depression 60 (FIGS. 1 and 2) in the upper surface of the lever, between the frangible means and the hinge, indicates where best to press.

An alternative form of the invention is shown in FIGS. 5 and 6. The plug assembly is identical to that described above, but the outer ring 110 differs from the ring previously described in that it is installed inside the mouth of the container. Therefore, the plug seals against the inside surface of the ring 110, not directly against the container wall. The ring illustrated has an internal groove which helps retain the ring in the container mouth, but as described above, this may not be necessary.

In the embodiment according to FIGS. 5 and 6, the skirt 122 is circumferential and covers the outer rim of plug 132 without interruption. Hinge 136 between plug 132 and lever 134 is positioned closer to the center to allow skirt 122 to snap over plug 132. The plug 132 is hingedly connected by a hinge 142 to the outer ring 110.

Figure 7:
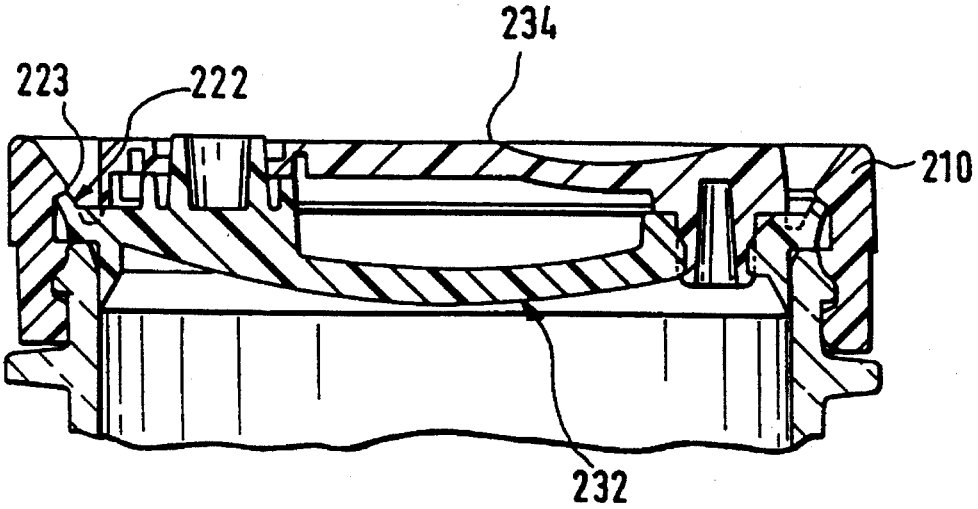
FIG. 7 is a view like FIG. 2 showing a third embodiment of the invention.

A second alternative form of the invention is shown in FIG. 7. The plug assembly is identical to that described in connection with FIGS. 1 to 4, but the outer ring 210 differs from the ring previously described in that flexible skirt 222 extends around plug 232 and free edge 223 is positioned directly on the inside surface of ring 210. Therefore, when the plug 232 is pressed into the ring 210, the flexible skirt 222 is deflected inwardly to snap under free edge 223. As shown in FIG. 7, flexible skirt 222 seats against edge 223 and prevents withdrawal.

As material for the closure assembly thermoplastic material, particularly polyethylene, polypropylene or PET is used. Conventional injection molds may be used to manufacture it. Also, compression molds can be applied. The closure as shown is a one-component closure. To improve sealing properties a special sealing, such as an O-ring or a liner may be applied to improve the sealing properties between the outer ring and the container and/or the outer ring and the plug and/or the plug and the container.

While the invention is described and shown installed on a bottle, it is applicable to containers generally, the more general term being used in the claims below.

Since the invention is subject to modifications and variations, it is intended that the foregoing description and the accompanying drawings shall be interpreted as only illustrative of the invention defined by the following claims.

I claim:

1. In a closure for sealing the mouth of a container, said closure comprising an outer ring for durable installation on the container at its mouth, said ring having an opening substantially coextensive with said mouth, a sealing assembly installed in said ring to seal the mouth, said assembly comprising a plug having a sealing lip on its lower face and an annular overhang extending outwardly of the lip, and a release lever connected to said plug, and movable between a closed position in which it lies against the plug, and an opening position in which it is out of contact with the plug to pry the plug out of the opening, the improvement wherein said ring has an internal flexible skirt having a free edge directed downwardly and inwardly so as to permit said plug to pass through the ring during assembly to seal the container, but to resist removal of the plug sufficiently to prevent it from being forced off the container by pressure within the container.

2. A closure according to claim 1 wherein the plug has a peripheral undercut in its upper surface, about the same diameter as said skirt, for engaging the bottom edge of the skirt in the closed position.

3. A closure according to claim 1, wherein the plug and the release lever are integral, being interconnected by a flexible continoues hinge.

4. A closure according to claim 3, wherein the plug has a vent hole and the release lever has a vent plug on its lower surface which fills the vent hole when the release lever is in the closed position.

5. A closure according to claim 3, wherein said release lever is maintained in its closed position by frangible means for providing tamper evidence, said frangible means being broken when the release lever is moved to its open position.

6. A closure according to claim 1, wherein the ring is mounted on the outside surface of the container, around the mouth, and the sealing lip bears directly against the inside of the container mouth.

7. A closure according to claim 1, wherein the ring is mounted partially within the container's mouth and the sealing lip bears against the inside surface of the ring.

8. A closure according to claim 1, wherein the release lever in its opening position bears against a portion of the ring, which acts as a fulcrom to pry the plug out of theening.

9. In a closure for sealing the mouth of a container, said closure comprising an outer ring for durable installation on the container at its mouth, said ring having an opening substantially coextensive with said mouth, a sealing assembly installed in said ring to seal the mouth, said assembly comprising a plug having a sealing lip on its lower face and an annular overhang extending outwardly of the lip, and a release lever connected to said plug, and movable between a closed position in which it lies against the plug, and an opening position in which it is out of contact with the plug to pry the plug out of the opening, the improvement wherein said ring having a free edge directed downwardly and inwardly and said plug having a flexible skirt directed upwardly and outwardly so as to permit said plug to pass through the ring during assembly to seal the container, but to resist removal of the plug sufficiently to prevent it from being forced off the container by pressure within the container.

10. A closure according to claim 9, wherein the plug and the release lever are integral, being interconnected by a flexible continuous hinge.

11. A closure according to claim 10, wherein the plug has a vent hole and the release lever has a vent plug on its lower surface which fills the vent hole when the release lever is in said closed position.

12. A closure according to claim 10, wherein said release lever is maintained in its closed position by frangible means for providing tamper evidence, said frangible means being broken when the release lever is moved to its open position.

13. A closure according to claim 9, wherein the ring is mounted on the outside surface of the container, around the mouth, and the sealing lip bears directly against the inside of the containers mouth.

14. A closure according to claim 9, wherein the ring is mounted partially within the container's mouth, and the sealing lips bears against the inside surface of the ring.

15. A closure according to claim 9, wherein the release lever in its opening position bears against a portion of the ring, which acts as locus to pry the plug out of the opening.

* * * * *

UNITED STATES PATENT AND TRADEMARK OFFICE

CERTIFICATE OF CORRECTION

PATENT NO. : 5,622,273

DATED : April 22, 1997

INVENTOR(S) : Ronald L. Kelly

It is certified that error appears in the above-indentified patent and that said Letters Patent is hereby corrected as shown below:

Column 1, Line 10, delete "seating with" and insert --sealing with-- therefor.

Column 1, Line 57, delete "the ring my be pried" and insert --the ring may be pried-- therefor.

Column 2, Lines 26-27, delete "and the outer the ring." and insert --and the outer ring.-- therefor.

Column 3, Line 6, delete "and hollow it to spring back into its" and insert --and allow it to spring back into its-- therefor.

Column 3, Line 18, delete "further" and insert --Further-- therefor.

Column 4, Line 29, delete "continoues" and insert --continuous-- therefor.

Column 4, Line 47, delete "plug out of theening." and insert --plug out of the opening.-- therefor.

UNITED STATES PATENT AND TRADEMARK OFFICE

CERTIFICATE OF CORRECTION

PATENT NO. : 5,622,273

DATED : April 22, 1997

INVENTOR(S) : Ronald L. Kelly

It is certified that error appears in the above-indentified patent and that said Letters Patent is hereby corrected as shown below:

Column 6, Line 8, delete "sealing lips bears" and insert -- sealing lip bears-- therefor.

Signed and Sealed this

Fifth Day of August, 1997

Bruce Lehman

*Attest:*

BRUCE LEHMAN

*Attesting Officer*

*Commissioner of Patents and Trademarks*